United States Patent [19]

Darwin

[11] 3,939,766

[45] Feb. 24, 1976

[54] TEXTILE SHADE MARKER

[76] Inventor: Frank S. Darwin, 7005 Yorkshire, Knoxville, Tenn. 37919

[22] Filed: July 15, 1974

[21] Appl. No.: 488,308

[52] U.S. Cl. ..... 101/92; 101/103; 101/106

[51] Int. Cl.[2] ..... B41L 47/46

[58] Field of Search ..... 101/91, 92, 101, 103, 106, 101/108

[56] References Cited

UNITED STATES PATENTS

| | | | |
|---|---|---|---|
| 711,590 | 10/1902 | Post | 101/92 X |
| 2,152,204 | 3/1939 | Moore | 101/91 |
| 2,307,264 | 1/1943 | Hamlin | 101/92 |
| 2,477,703 | 8/1949 | Osten | 101/106 X |
| 3,138,092 | 6/1964 | Block | 101/91 |
| 3,731,621 | 5/1973 | Neckel | 101/103 X |
| 3,734,012 | 5/1973 | Huggins | 101/103 |

*Primary Examiner*—Edgar S. Burr
*Assistant Examiner*—Edward M. Coven
*Attorney, Agent, or Firm*—John A. Hamilton

[57] ABSTRACT

A textile shade marker for imprinting identifying indicia such as numerals, on the reverse side of each layer of fabric as the fabric is laid out in a multiple layer stack on a cutting table preparatory to the cutting thereof into garment panels, the marker consisting of a frame carrying printing wheels having series of indicia printing elements on the peripheries thereof, and which are rotated by movement of the fabric in engagement therewith, and mechanism for applying ink only to a selected printing element, whereby all of said printing elements engage the fabric but only the selected element imprints its image thereon.

8 Claims, 9 Drawing Figures

TEXTILE SHADE MARKER

Figure 1:
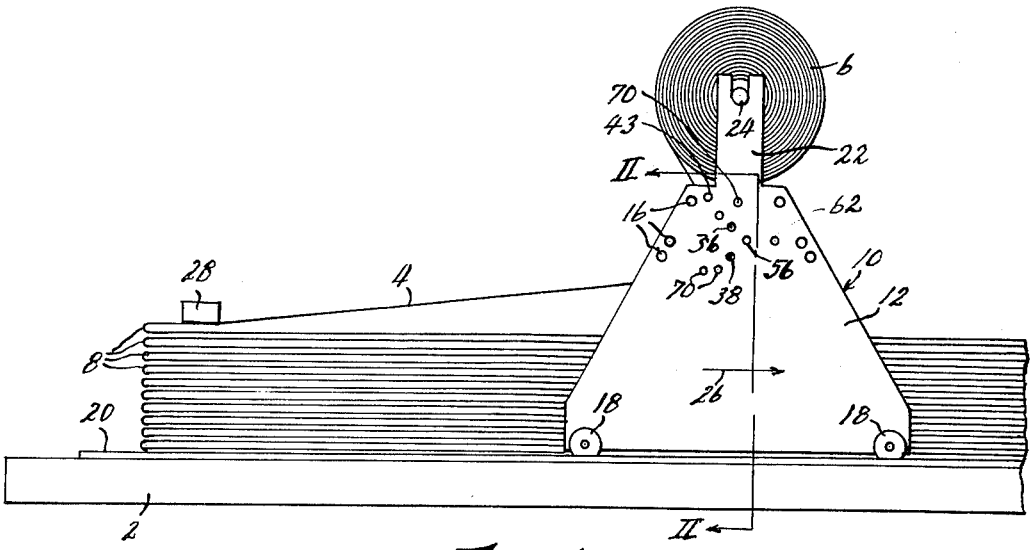

This invention relates to new and useful improvements in textile marking devices, and has particular reference to a device useful in the process commonly known as "shade marking."

In the garment industry, long lengths of fabric are commonly fed from a bolt of cloth carried by a wheeled carriage as said carriage is moved alternately in opposite directions over a cutting table, whereby the cloth is laid on the table in a large number of layers. Patterns for garment panels are then laid out on the top layer of cloth in the stack, and all of the layers are cut to these patterns simultaneously by special cutters capable of performing this operation with great accuracy and efficiency. However, a commonly encountered problem in this operation is that in dyed cloth, the color often is not uniform throughout even a single bolt thereof, but may vary considerably as to color shade or tone. Therefore, to assure garments in which all of the panels are color-matched to a sufficient accuracy, it is desirable that all of the panels of each garment, as they are assembled for sewing, be selected insofar as possible from the same layer of cloth as it originally rested on the cutting table. To assist in this operation, it has become common practice to imprint on the reverse side of the cloth a different identifying indicia, such as a numeral, on each layer of cloth as it is laid out on the table. The numerals or other indicia are imprinted at sufficiently close intervals to insure that every garment panel eventually cut from the cloth, no matter how small, will be identified by at least one marking on its reverse side. In this manner, the panels for each garment may be selected and assembled for sewing by matching indicia, rather than by the eye, the latter process being inefficient because of poor color perception by some individuals, and poor lighting. This process of marking the fabric with identifying indicia is commonly known as "shade marking." Shade marking is also sometimes performed manually, as by hand stamping the individual garment panels after they are cut out, but the present invention is concerned with the at least semi-automatic operation described above.

In that type of operation, the indicia, which for convenience will hereinafter be referred to as numbers, digits or numerals, are usually applied to the cloth by printing wheels rolling against the cloth, to which ink is applied, and the provision for insuring that only a particular selected digit of the wheel will receive ink and apply it to the cloth. This has heretofore resulted in complicated, expensive structures. For example, generally triangular or otherwise polygonal printing wheels have been used, with the digits carried by a flexible belt adjustable around the wheel, so that the digits positioned at the angles of the wheel are farthest from the wheel axis, so that only they contact some ink applying surface, and the cloth, as the wheel rotates. The principal object of the present invention, accordingly, is the provision of a highly simplified, economical device which will perform this function dependably and efficiently.

Generally, this object is accomplished by the use of circular printing wheels with numeral printing elements arranged about the peripheries thereof, all of the elements thus engaging the cloth as the wheel rotates in engagement with the cloth. However, each printing wheel is inked by an interrupted surface so as to present inking surfaces to apply ink only to a numeral of the printing wheel having a specified angular relation to the inking wheel. The printing wheel may be angularly adjusted, independently of the inking wheel, to bring any selected numeral thereof to this specified angular relation, so that only this numeral will actually be printed on the cloth.

Another object is the provision of a shade marker of the character described which is driven automatically by movement of the carriage carrying the bolt of cloth back and forth over the cutting table, the only manual operation required being the resetting of the number to be printed on the cloth after the laying out of each layer of cloth is completed.

A further object of the present invention is the provision of a shade marker of the character described which is readily adaptable to print numerals on the cloth at virtually any desired intervals, both longitudinally of and transversely to the direction of travel of the cloth.

Other objects are simplicity and economy of construction, and efficiency and dependability of operation.

Figure 3:
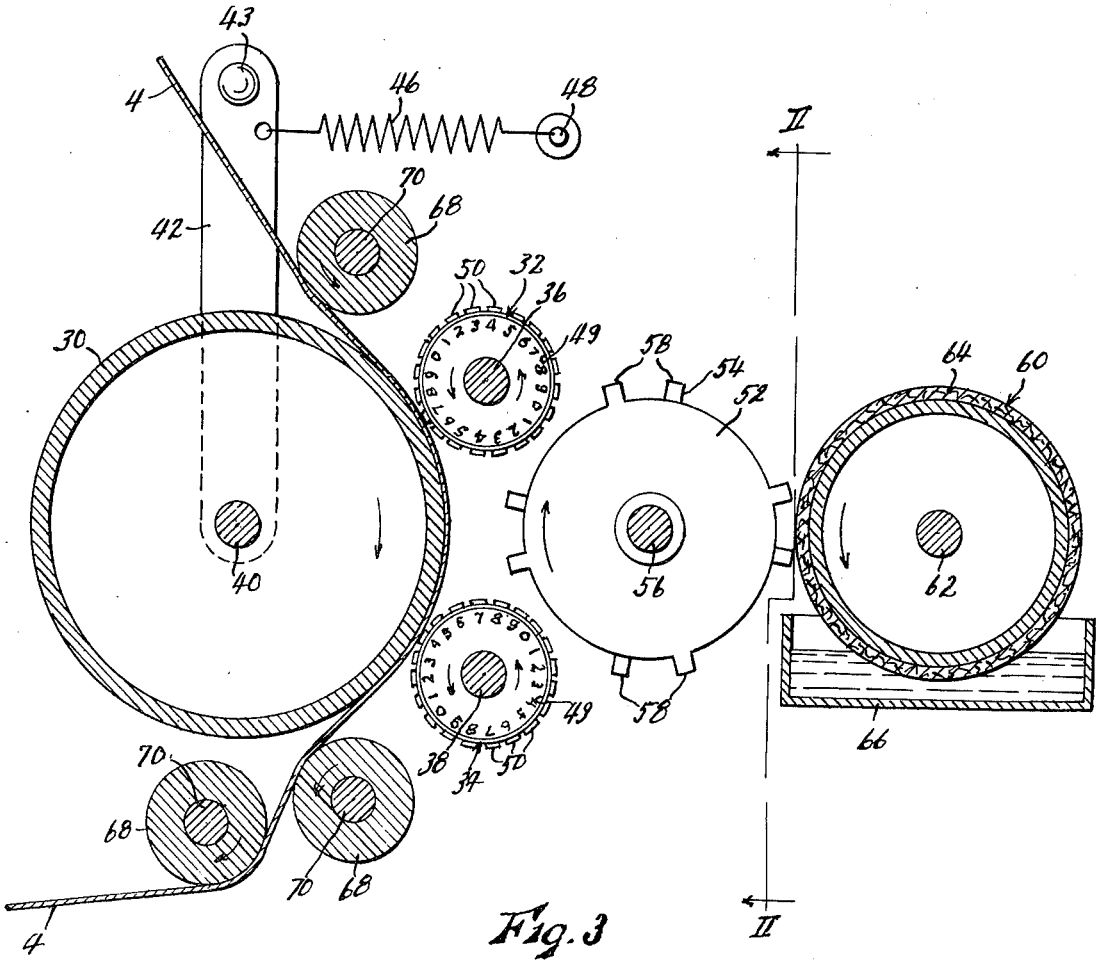
Figure 2:
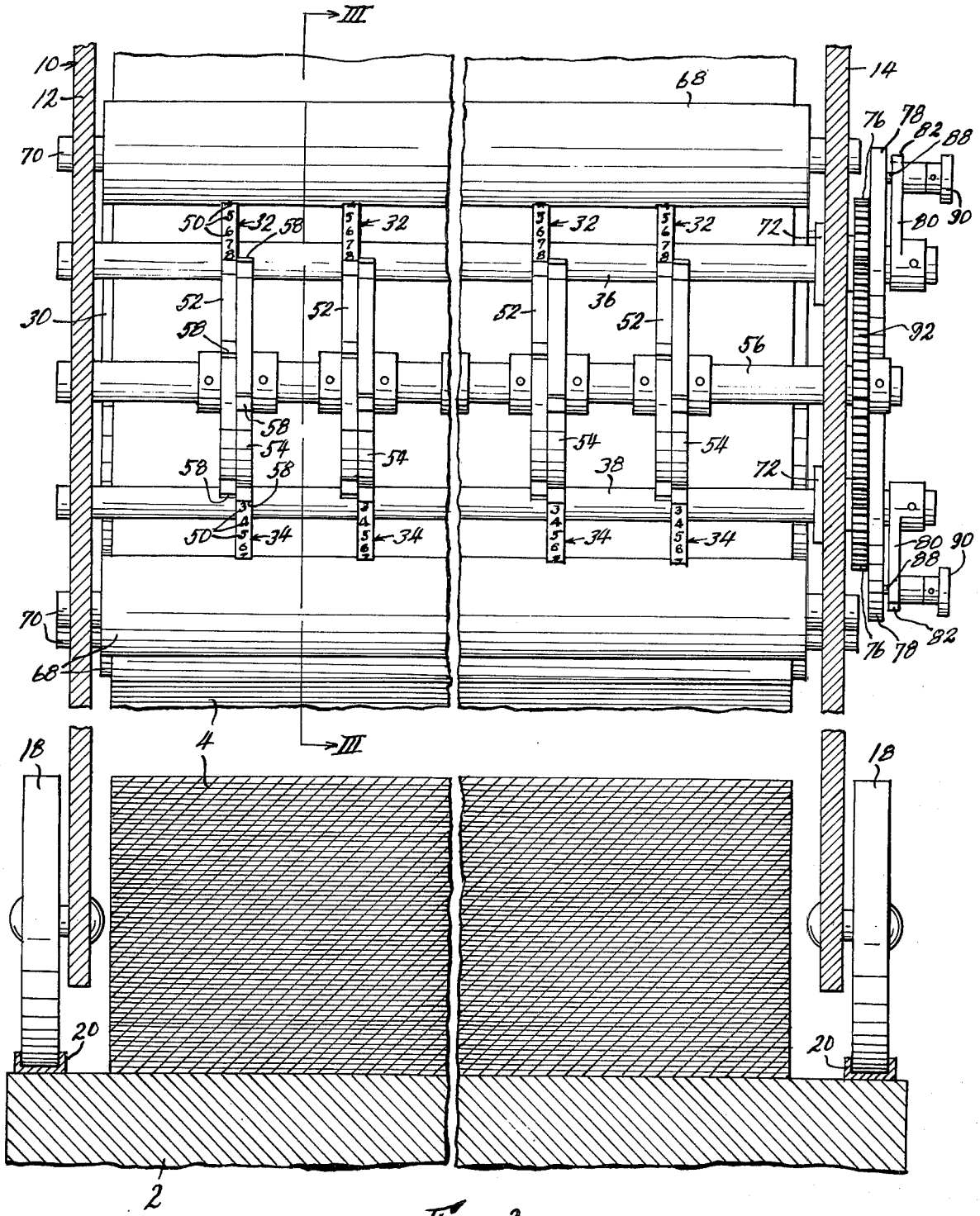
Figure 4:
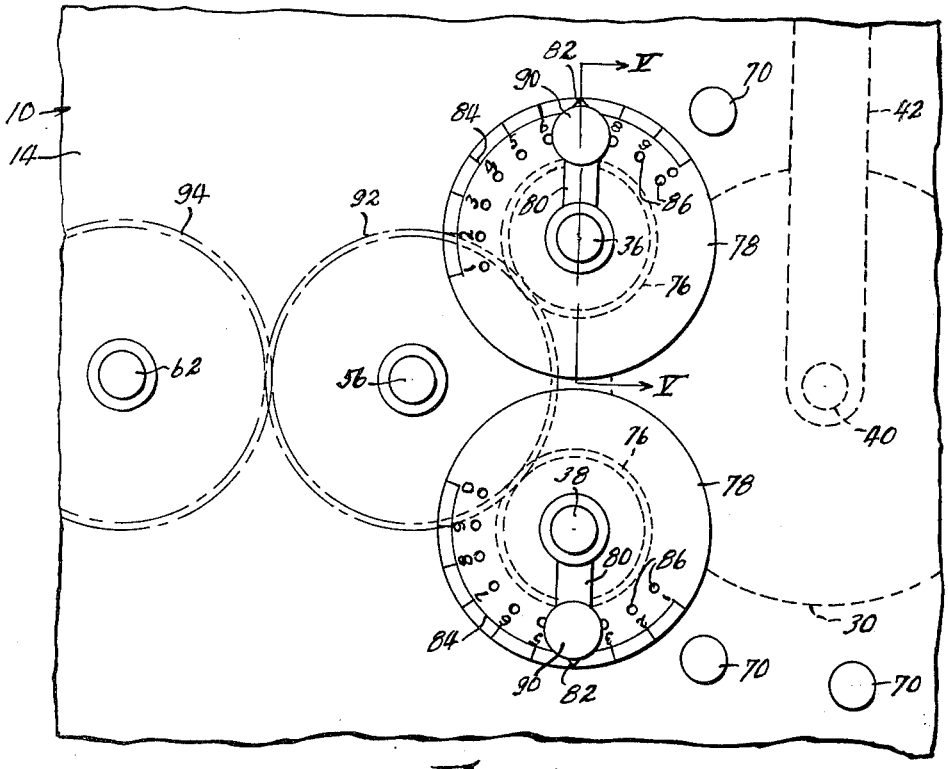
Figure 5:
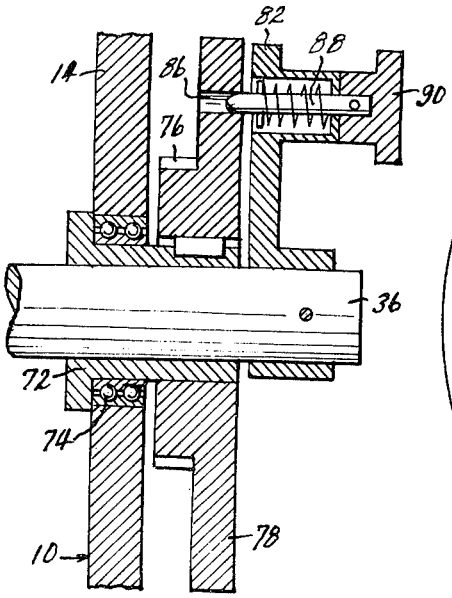
Figure 9:
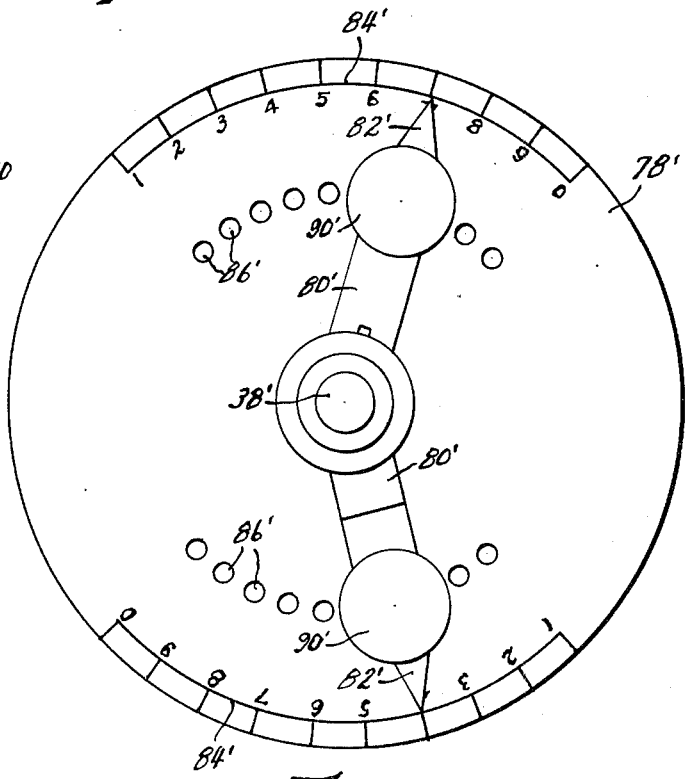
Figure 6:
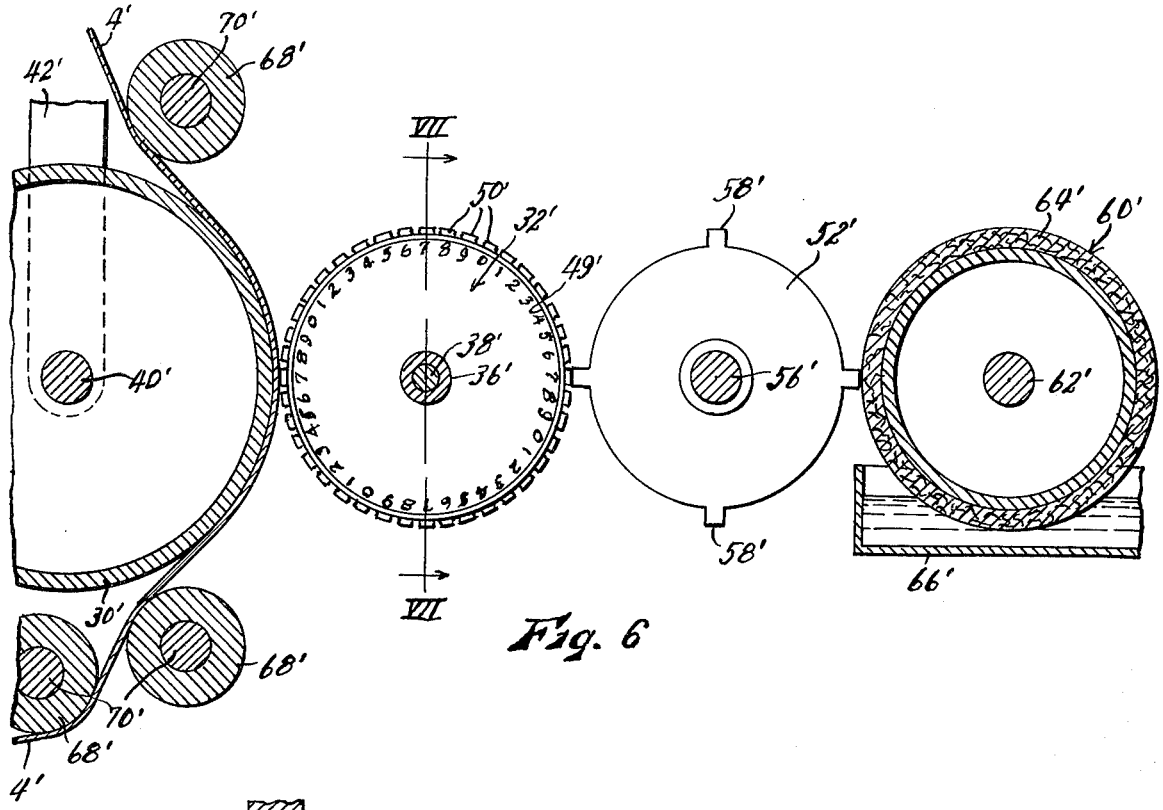
Figure 7:
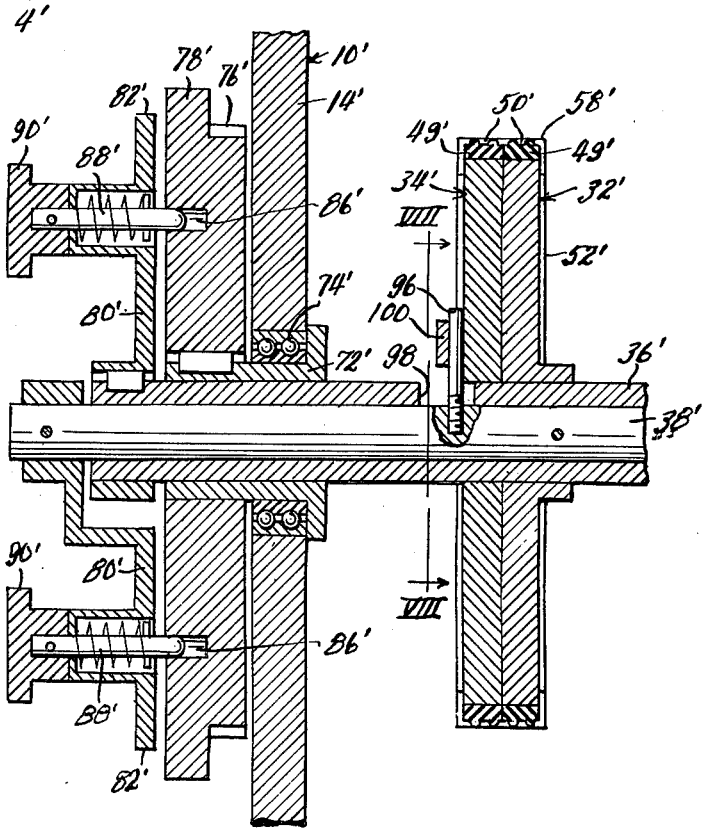
Figure 8:
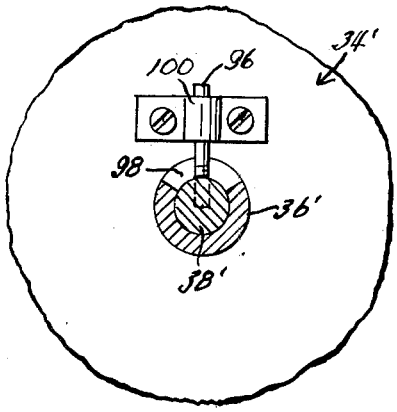

With these objects in view, as well as other objects which will appear in the course of the specification, reference will be had to the accompanying drawing, wherein:

FIG. 1 is a fragmentary side elevational view of a cutting table having a carriage mounted thereon for movement in alternately opposite directions to lay out cloth from a bolt carried by the carriage in layers on said table, said carriage including a shade marking device embodying the present invention, FIG. 2 is an enlarged sectional view, partially broken away and foreshortened, taken on line II—II of FIG. 1, line II—II also being indicated in FIG. 3, FIG. 3 is a fragmentary sectional view taken on line III—III of FIG. 2, FIG. 4 is a fragmentary right side elevational view of the device as shown in FIG. 2, FIG. 5 is an enlarged, fragmentary sectional view taken on line V—V of FIG. 4, FIG. 6 is a view similar to FIG. 3, but showing a modified form of construction, FIG. 7 is an enlarged, fragmentary sectional view taken on line VII—VII of FIG. 6, FIG. 8 is a fragmentary sectional view taken on line VIII—VIII of FIG. 7, and FIG. 9 is a left side elevational view of the parts shown in FIG. 7.

Like reference numerals apply to similar parts throughout the several views, and the numeral 2 applies to a cutting table such as is commonly used in the garment industry, said table being planar and rectangular, being somewhat wider than the transverse width of the cloth being used, and of any desired length, lengths of fifty feet or more being common. The cloth 4, which is supplied rolled in a bolt, one of which is shown at 6, is to be laid out on the table in layers as shown being reversed by a fold 8 at the end of each layer, in order that identical garment panels may be cut simultaneously from all of the layers by special cutters. For this purpose, cloth bolt 6 is mounted in a carriage indicated generally by the numeral 10 and including a pair of vertical side plates 12 and 14 disposed parallel to the longitudinal extent of the table at respectively opposite sides thereof, said side plates being rigidly connected together by transverse cross bars 16 adjacent their upper edges, and each having rotatably mounted wheels 18 at its lower edge engaged in a channel track member 20 affixed longitudinally to the table, whereby the carriage is supported and guided for movement longitudinally of the table. Each side plate is provided with an upwardly projecting leg 22, and a horizontal transverse axle 24 journalled in said legs supports cloth bolt 6 for axial rotation. Therefore, as the carriage is moved in alternately opposite directions along the table, and cloth 4 is paid out from the bolt, said cloth is laid out on the table in layers as shown. Movement of the carriage may be accomplished either manually or by power means. As shown in FIG. 1, carriage 10 is being moved to the right as indicated by arrow 26. When movement of the carriage was last reversed to commence movement in the direction shown, a heavy bar weight 28 was laid on the top cloth layer adjacent the fold 8, in order to supply the resistance to movement of the cloth which permits movement of the carriage to cause rotation of bolt 6 and paying out of the cloth therefrom.

The shade marking device forming the subject matter of the present invention is carried in carriage 10, and is operable to print identifying indicia on the reverse side of the cloth immediately after the cloth leaves bolt 6, but before it is laid on the table, with provisions for changing the imprinted indicia for each successive layer of cloth.

The shade marking device, as shown in FIGS. 1–5, includes an anvil roller 30 and two sets of printing wheels 32 and 34, the cloth being led between said anvil roller and printing wheels so that its reverse surface faces the printing wheels. Printing wheels 32 are mounted fixedly on a common shaft 36 extending transversely across carriage 10, so as to be engaged by the anvil roller, and are spaced regularly along the length of said shaft so as to print numerals at the desired intervals transversely of the cloth. Common cloth widths are 48 or 60 inches, and as shown wheels 32 are arranged to print numerals at three-inch intervals across the width of the cloth, although this of course is a matter of choice. Printing wheels 34 are spaced below wheels 32, also so as to engage the anvil roller, being mounted in axially spaced relation along a common shaft 38 extending transversely across carriage 10. Wheels 34, however, are axially offset from wheels 32 so that they print digits immediately adjacent those printed by wheels 32, so that the cloth is marked with two-digit numerals. Anvil roller 30 is mounted rotatably on an axle 40 extending transversely across the carriage, being affixed at each end to the lower end of an arm 42 disposed adjacent the associated carriage side wall, and pivoted at its upper end to said side wall, as at 43. The anvil roller may thus be pivoted away from the printing wheels, to permit threading of the cloth therebetween. However, arms 42 are biased resiliently in a direction to urge the anvil roller against said printing wheels by a spring 46 (see FIG. 3) anchored at its opposite end to the associated carriage side wall, as at 48, with sufficient force that the cloth, when pulled therebetween, causes rotation of the anvil roller and both sets of printing wheels. Each printing wheel has a peripheral covering 49 of rubber or other yieldable material, having formed thereon one or more series of raised numerals from 1 to 0 designated at 50. In FIGS. 3 and 6, these numerals are for convenience identified by numerals imprinted on the faces of the wheels. The angular spacing between a given numeral of each of the series is such that said numeral contacts the cloth at longitudinal intervals therealong corresponding to the desired intervals for marking the cloth. For example, in FIG. 3 the printing wheels may be considered as having 6 inch circumferences, and each carries two series of numerals from 1 to 0. Therefore, any given numeral will contact the cloth at three-inch numerals along a line parallel to the cloth travel.

Associated with each printing wheel 32 is an inking wheel 52, and associated with each of printing wheels 34 is an inking wheel 54. All of said inking wheels are affixed on a common shaft 56 extending transversely of the carriage and journalled in the side plates thereof. Each inking wheel is provided with angularly spaced apart raised inking faces 58 each adapted to engage its associated printing wheel as the wheels rotate. The printing and inking wheels are provided (by means to be described) with equal peripheral speeds, and the inking faces of the latter are spaced angularly at such intervals that any given numeral will be engaged by and receive ink from an inking face 58 each time it passes the inking wheel. As shown, each printing wheel has two series of numerals, so that corresponding numerals of the two series are spaced 180° apart, but is only one-half the diameter of the inking wheels. Therefore, each inking wheel requires four inking faces 58, spaced at 90° intervals. Each inking face is of such size that it can apply ink only to one numeral of the associated printing wheel. By adjustably indexing the printing wheels relative to the inking wheels (also by means to be described), any selected numeral of each printing wheel may be inked, while no ink is applied to any other numeral.

Arranged to contact the inking faces 58 of all of the inking wheels is an ink reservoir roller 60 mounted on an axle 62 extending transversely of the carriage and journalled in its side plates. Said reservoir roller is provided with a soft, absorbent covering 64, the lower portion of which dips into a liquid ink reservoir 66 mounted in the carriage. Alternatively, ink for long periods of usage can be pre-impregnated into the covering of the roller so that no liquid ink reservoir is required. Also, the reservoir roller is rotated by means to be described. Guide rollers 68, which are free-turning, may be mounted in carriage 10 both above and below anvil roller 30, as by transverse axles 70 journalled in the carriage side plates, to insure the proper attitude of the cloth relative to the anvil roller and printing wheels at all times.

Each of the printing wheel shafts 36 and 38 is journalled at one end in carriage side plate 12, and its opposite end portion is journalled rotatably in a sleeve 72 (see FIG. 5) which in turn is journalled rotatably in carriage side plate 14, as by ball bearing 74. Both the shaft and the sleeve project outwardly from said carriage side plate. Fixed on the extended portion of said sleeve is a gear 76, the pitch diameter of which is equal to the effective diameter of the printing wheels, and a circular index plate 78. Fixed to the extended end of the shaft is a radially extending index arm 80, having at its free end a pointer 82 movable over a scale 84 imprinted on the index plate. The scale indicia are numbered from 1 to 0, and are angularly spaced equal to the angular spacing between successive numerals 50 on the printing wheels. The index plate is provided with a socket 86 for each position of the scale, and the associated index arm 80 is provided with a spring-loaded detent pin 88 engageable selectively in any of sockets 86. The detent pin may be retracted by means of a finger knob 90.

The two gears 76 do not mesh with each other, but both mesh with a single gear 92 fixed on the extended end portion of shaft 56 of the inking wheels, the pitch diameter of gear 92 being equal to the diameter of the inking wheels 52-54 across the inking faces 58 thereof. Thus the printing and inking wheels thereby are caused to rotate with equal linear peripheral speeds, this travel being powered by and equal to the linear speed of the cloth. Gear 92 is also meshed with a gear 94 fixed on the extended end portion of shaft 62 carrying ink reservoir roller 60, so that said reservoir roller is also rotated to apply ink to the inking faces of the inking wheels as both rotate. Gears 92 and 94 need not be of equal pitch diameters, and in fact preferably are not, since this provides that the inking faces 58 will not engage precisely the same spots of the reservoir roller on every revolution of the wheels, and thus distributes the wearing of the reservoir roller covering 64 over wider areas and increases the useful life of said covering.

In operation, therefore, it will be seen that as carriage 10 is moved in either direction along tracks 20 of table 2, and cloth is pulled from bolt 6 by the resistance to cloth travel provided by weight bar 28, the travel of the cloth rotates anvil roller 30 and printing wheels 32 and 34. All of the printing wheel numerals 50 engage the cloth, but only one numeral will have been inked, and only that numeral will actually print. As actually shown, printing wheels 32 are adjusted to print the numeral 7, since a consideration of FIG. 3 will reveal that it is only when numeral 7 of these wheels comes opposite their inking wheels 52, will inking faces of wheels 52 be present to apply ink. Printing wheels 34 are shown adjusted to print the numeral 4 after the cloth has moved from wheels 32 to wheels 34, with the numeral 4 appearing immediately after the numeral 7, so that the cloth is marked repeatedly with the two-digit numeral 74, at three-inch intervals both transversely to and parallel with the direction of travel of the cloth. These intervals may be selected as desired, usually dictated by the minimum size of the garment panels to be cut, so as to insure the marking of each panel with at least one numeral. The angularity between the two sets of printing wheels, relative to the anvil roller, need not be fixed, but may be varied as desired. The desired points of the anvil roller at which printing from each set is desired to occur are selected as desired, although changing of the printing positions from those shown will require angular adjustment of inking wheels 52 and 54 relative to shaft 56. Also, it will be apparent that three or even more sets of printing wheels may be used, rather than the two shown, so that numerals each containing three or more digits may be imprinted if desired.

After the deposition of a layer of cloth 4 on table 2 has been completed, the direction of travel of carriage 10 relative to the table is reversed to commence the depositing of the next higher layer, the weight bar 28 at that end of the stack of layers of course being transferred to the top of the new layer just after the laying of the new layer is commenced. Movement of the carriage is arrested at the time of reversing its travel, and at this time the operator arranges the printing wheels to print a different numeral on the new layer. He accomplishes this by pulling out the finger knob 90 of either or both of index arms 80 to release the associated detent pin 88 from index plate 78, turning said index arm relative to said index plate to bring pointer 82 into registry with the mark of scale 84 corresponding to another numeral of the associated printing wheels, and releasing finger knob 90 to engage detent pin 88 in the index plate socket 86 corresponding to the newly selected numeral. In this manner, the associated printing wheel will be angularly adjusted relative to the inking wheels so that only the newly selected numeral will receive ink from the inking wheels. Normally, the cloth layers will be numbered consecutively from the bottom of the stack upwardly, with two-digit numerals, the numerals printed by wheels 32 being the "tens" digit, and the numerals printed by wheels 34 being the "units" digit. Thus, with two sets of printing wheels, the cloth layers may be numbered from 00 to 99.

The species of the invention shown in FIGS. 6–9 is generally similar to that shown in FIGS. 1–5, corresponding parts bearing corresponding primed numerals, except that printing wheels 32′ and 34′ are mounted coaxially with each other, shaft 36′, on which wheels 32′ are fixed, being tubular and having wheels 34′ mounted rotatably thereon, while shaft 38′ is disposed rotatably within shaft 36′ and is affixed to each printing wheel 34′ by a rod 96 affixed at its inner end in shaft 38′, extending radially outwardly through an angularly elongated slot 98 formed in tubular shaft 36′, and affixed at its outer end to the corresponding wheel 34′ by means of a bracket 100 (see FIGS. 7 and 8). Thus the two digits of a two-digit numeral may be brought into angular registry on the composite printing wheel, so that both digits of the numeral are printed on the cloth simultaneously. As shown, each printing wheel carries four consecutive sets of numerals from 1 to 0, so that any selected two-digit numeral occurs four times at 90° intervals around the periphery of the composite printing wheel. Each composite printing wheel 32′–34′ is served by a single inking wheel 52′ mounted on shaft 56′, the diameter of said inking wheel across its inking faces 58′ being equal to the effective diameters of the printing wheels, each inking face being sufficiently wide to apply ink to a single pair of angularly registered numerals of a composite pair 32′–34′ of printing wheels. Inking wheels 52′ have ink applied to them by an ink reservoir roller 64′ and ink reservoir 66′ as before.

Shafts 36′ and 38′ extend outwardly through carriage side plate 14, shaft 36′ being journalled in a sleeve 72′ rotatably mounted in said side plate by bearing 74′, a gear 76′ and circular index plate 78′ being affixed concentrically on an outwardly extended end portion of sleeve 72′, and it will be understood that gear 76′ is meshed with a gear 92′ of equal pitch diameter fixed on the shaft 56′ of the inking wheels. Index plate 78′ carries two scales 84′ corresponding to the scales 84 of both index plates 78 in FIG. 4, each scale being traversed by an index arm 80′ corresponding respectively to the index arms 80 of FIG. 4. One of index arms 80′ is fixed on tubular shaft 36′, and the other on shaft 38′. Since inking wheels 32′–34′ each contain four sets of numerals from 1 to 0, full adjustment of the device to print any number from 00 to 99 can be obtained with only 90° of movement of each index arm 80′ relative to the index plate 78′. The operation of this species is substantially similar to that of the species of FIGS. 1–5.

While I have shown and described certain specific embodiments of my invention, it will be readily apparent that many minor changes of structure and operation may be made without departing from the spirit of the invention.

What I claim as new and desire to protect by Letters Patent is:

1. A textile shade marking device comprising:

a. a frame through which a width of fabric is moved continuously in one direction, b. a printing wheel carried by said frame for rotation about an axis parallel to the plane of said cloth and transverse to said direction of travel, said printing wheel having a series of angularly spaced raised printing elements on its peripheral surface, and engaging said cloth, c. driving means carried by said frame and operable to cause said printing wheel to turn at a peripheral linear speed equal to the speed of movement of said cloth, d. inking means carried by said frame and operable to apply ink only to certain of said printing elements during each rotation of said printing wheel, whereby only said inked printing elements will imprint their images on said cloth, said inking means comprising, an inking wheel carried by said frame for rotation on an axis parallel to the axis of said printing wheel, and having one or more raised inking faces operable to engage the printing elements of said printing wheel as said inking wheel rotates, the angular extent of each inking face being such that it can apply ink to only a single printing element of said printing wheel, the linear circumferential spacing between certain of said inking faces, relative to said inking wheel, being equal to the circumference of said printing wheel, e. means operable to turn said inking wheel at a linear peripheral speed equal to that of said printing wheel, f. means operable to apply ink to the inking faces of said inking wheel, and g. selector means operable to adjust said inking wheel to apply ink selectively to any of said printing elements.

2. The device as recited in claim 1 wherein said selector means comprises means for selectively altering the relative angular position of said printing wheel relative to that of said inking wheel, whereby to cause said inking wheel to apply ink only to any selected printing element of said printing wheel.

3. The device as recited in claim 1 wherein said means operable to turn said inking wheel comprises a pair of meshing gears affixed respectively to and rotatable with said printing and inking wheels, and having the same ratio of diameter as said wheels, and wherein said selector means comprises means for adjusting the angular position of one of said wheels relative to its associated gear.

4. The device as recited in claim 1 wherein the printing elements of said printing wheel consist of a plurality of series of digits from 1 to 0 arranged consecutively around the periphery of said wheel, and wherein the linear peripheral spacing of said inking faces of said inking wheel, relative to said inking wheel, is equal to the linear peripheral spacing between corresponding digits of said series of printing wheel digits, relative to said printing wheel, said selector means comprising means for changing the relative angular positions of said printing and inking wheels, so that the inking faces of the latter engage and apply ink to all occurrences of any selected digit of said printing wheel.

5. The device as recited in claim 4 including a plurality of said printing wheels carried in spaced relation on a common axis transverse to the direction of cloth travel, and an inking wheel cooperating with each printing wheel, corresponding digits of all of said printing wheels, and corresponding inking faces of all of said inking wheels, being disposed in angular registry, whereby the selected digit is imprinted on said cloth at intervals across the width thereof transverse to its direction of travel.

6. The device as recited in claim 4 including a second printing wheel and associated inking wheel, said second printing wheel also engaging said cloth but being offset from said first printing wheel in a direction parallel to their axes, and a second selector means operable to control the digit to be imprinted by said second printing wheel and operable independently of said first selector means, whereby any selected two-digit numeral may be imprinted on said cloth.

7. The device as recited in claim 6 wherein the axes of the two printing wheels are spaced laterally apart, and wherein the associated inking wheels are coaxial with each other, corresponding inking faces of said inking wheels being angularly offset at such distances that the numeral imprinted by said second printing wheel is disposed directly adjacent that imprinted by said first printing wheel, to comprise a two-digit numeral conjointly.

8. The device as recited in claim 6 wherein said two printing wheels are disposed coaxially in side-by-side relation, whereby to print both digits of a two-digit numeral simultaneously.

* * * * *